US005951243A

United States Patent [19]

Cooper

[11] Patent Number: 5,951,243

[45] Date of Patent: Sep. 14, 1999

[54] ROTOR BEARING SYSTEM FOR MOLTEN METAL PUMPS

[76] Inventor: Paul V. Cooper, 11247 Lake Forest Dr., Chesterland, Ohio 44026

[21] Appl. No.: 08/889,882

[22] Filed: Jul. 3, 1997

[51] Int. Cl.[6] ..... F04D 7/06

[52] U.S. Cl. ..... 415/110; 415/170.1; 415/173.1; 415/200; 416/174; 416/244 R

[58] Field of Search ..... 415/110, 170.1, 415/171.1, 172.1, 173.1, 173.5, 174.5, 229, 200; 416/174, 181, 231 R, 231 A, 241 R, 241 B, 244 R; 384/572; 266/235, 239; 417/423.12, 424.1

[56] References Cited

U.S. PATENT DOCUMENTS

| | | | |
|---|---|---|---|
| 209,219 | 10/1878 | Bookwalter | 415/173.5 |
| 251,104 | 12/1881 | Finch | 415/174.5 |
| 364,804 | 6/1887 | Cole | 415/229 |
| 506,572 | 10/1893 | Wagener . | |
| 585,188 | 6/1897 | Davis . | |
| 898,499 | 9/1908 | O'Donnell | 417/424.1 |
| 1,100,475 | 6/1914 | Franckaerts . | |
| 1,331,997 | 2/1920 | Neal | 416/231 R |
| 1,454,967 | 5/1923 | Gill . | |
| 1,518,501 | 12/1924 | Gill . | |
| 1,522,765 | 1/1925 | Wilke . | |
| 1,526,851 | 2/1925 | Hall . | |
| 1,669,668 | 5/1928 | Marshall | 417/424.1 |
| 1,673,594 | 6/1928 | Schmidt . | |
| 1,717,969 | 6/1929 | Goodner | 415/172.1 |
| 1,896,201 | 2/1933 | Sterner-Rainer . | |
| 2,038,221 | 4/1936 | Kagi . | |
| 2,290,961 | 7/1942 | Heuer . | |
| 2,488,447 | 11/1949 | Tangen et al. . | |
| 2,515,478 | 7/1950 | Tooley et al. . | |
| 2,566,892 | 9/1951 | Jacobs . | |
| 2,677,609 | 5/1954 | Moore et al. . | |
| 2,698,583 | 1/1955 | House et al. . | |
| 2,787,873 | 4/1957 | Hadley . | |
| 2,808,782 | 10/1957 | Thompson et al. . | |
| 2,821,472 | 1/1958 | Peterson et al. . | |
| 2,832,292 | 4/1958 | Edwards . | |
| 2,865,618 | 12/1958 | Abell . | |
| 2,901,677 | 8/1959 | Chessman et al. . | |
| 2,948,524 | 8/1960 | Sweeney et al. . | |
| 2,978,885 | 4/1961 | Davison . | |
| 2,984,524 | 5/1961 | Franzen . | |
| 2,987,885 | 6/1961 | Hodge . | |
| 3,048,384 | 8/1962 | Sweeney et al. . | |
| 3,070,393 | 12/1962 | Silverberg et al. . | |

(List continued on next page.)

FOREIGN PATENT DOCUMENTS

| | | | |
|---|---|---|---|
| 683469 | 3/1964 | Canada | 417/423.12 |
| 58-48796 | 3/1983 | Japan | 416/181 |
| 63-104773 | 5/1988 | Japan | 266/235 |
| 90756 | 1/1958 | Norway | 417/424.1 |
| 392268 | 9/1965 | Switzerland | 417/424.1 |
| 416401 | 6/1974 | U.S.S.R. | 266/235 |
| 773312 | 10/1980 | U.S.S.R. | 416/181 |
| 942648 | 11/1963 | United Kingdom | 416/181 |
| 1185314 | 3/1970 | United Kingdom . | |
| 2217784 | 11/1989 | United Kingdom | 415/229 |

OTHER PUBLICATIONS

Communication relating to the results of the Partial International search report for PCT/US97/22440 dated May 13, 1998.

*Primary Examiner*—Christopher Verdier
*Attorney, Agent, or Firm*—David E. Rogers; Squire, Sanders & Dempsey

[57] ABSTRACT

A system and device for pumping molten metal that reduces bearing member fractures comprises a pump having a pump chamber including a first bearing surface, a rotor having a second bearing surface that aligns with the first bearing surface. The second bearing surface is formed by a plurality of spaced bearing pins attached to the rotor. Each bearing pin has an outer surface preferably substantially flush with the outer perimeter of the rotor. The pins are comprised of a heat resistent material that is harder than the material comprising the rotor.

19 Claims, 13 Drawing Sheets

U.S. PATENT DOCUMENTS 3,092,030 6/1963 Wunder .
3,227,547 1/1966 Szekely .
3,251,676 5/1966 Johnson .
3,255,702 6/1966 Gehrm .
3,272,619 9/1966 Sweeney et al. .
3,289,473 12/1966 Louda .
3,291,473 12/1966 Sweeney et al. .
3,400,923 9/1968 Howie et al. .
3,459,346 8/1969 Tinnes .
3,487,805 1/1970 Satterthwaite .
3,512,762 5/1970 Umbricht .
3,512,788 5/1970 Kilbane ..... 415/172.1
3,575,525 4/1971 Fox et al. .
3,618,917 11/1971 Fredrikson .
3,650,730 3/1972 Derham et al. .
3,689,048 9/1972 Foulard et al. .
3,715,112 2/1973 Carbonnel .
3,743,263 7/1973 Szekely .
3,743,500 7/1973 Foulard et al. .
3,753,690 8/1973 Emley et al. .
3,759,635 9/1973 Carter et al. .
3,767,382 10/1973 Bruno et al. .
3,785,632 1/1974 Kraemer et al. .
3,814,400 6/1974 Seki .
3,836,280 9/1974 Koch .
3,839,019 10/1974 Bruno et al. .
3,871,872 3/1975 Downing et al. .
3,873,305 3/1975 Claxton et al. .
3,886,992 6/1975 Maas et al. .
3,915,694 10/1975 Ando .
3,954,134 5/1976 Maas et al. .
3,961,778 6/1976 Carbonnel et al. .
3,972,709 8/1976 Chia et al. .
3,984,234 10/1976 Claxton et al. .
3,997,336 12/1976 van Linden et al. .
4,003,560 1/1977 Carbonnel .
4,018,598 4/1977 Markus .
4,052,199 10/1977 Mangalick .
4,126,360 11/1978 Miller et al. ..... 415/172.1
4,128,415 12/1978 van Linden et al. .
4,169,584 10/1979 Mangalick .
4,286,985 9/1981 van Linden et al. .
4,322,245 3/1982 Claxton .
4,351,514 9/1982 Koch .
4,360,314 11/1982 Pennell .
4,370,096 1/1983 Church .
4,372,541 2/1983 Bocourt et al. .
4,392,888 7/1983 Eckert et al. .
4,410,299 10/1983 Shimoyama .
4,456,424 6/1984 Araoka .
4,504,392 3/1985 Groteke .
4,537,624 8/1985 Tenhover et al. .
4,537,625 8/1985 Tenhover et al. .
4,556,419 12/1985 Otsuka et al. .
4,557,766 12/1985 Tenhover et al. .
4,598,899 7/1986 Cooper .
4,609,442 9/1986 Tenhover et al. .
4,611,790 9/1986 Otsuka et al. .
4,634,105 1/1987 Withers et al. .
4,640,666 2/1987 Sodergard .
4,696,703 9/1987 Henderson et al. .
4,701,226 10/1987 Henderson et al. .
4,717,540 1/1988 McRae et al. .
4,743,428 5/1988 McRae et al. .
4,770,701 9/1988 Henderson et al. .
4,786,230 11/1988 Thut .
4,802,656 2/1989 Hudault et al. .
4,804,168 2/1989 Otsuka et al. .
4,810,314 3/1989 Henderson et al. .
4,842,227 6/1989 Harrington et al. .
4,844,425 7/1989 Piras et al. .
4,851,296 7/1989 Tenhover et al. .
4,859,413 8/1989 Harris et al. .
4,867,638 9/1989 Handtmann et al. ..... 415/172.1
4,884,786 12/1989 Gillespie .
4,898,367 2/1990 Cooper .
4,923,770 5/1990 Grasselli et al. .
4,930,986 6/1990 Cooper .
4,931,091 6/1990 Waite et al. .
4,940,214 7/1990 Gillespie .
4,940,384 7/1990 Amra et al. .
4,954,167 9/1990 Cooper .
4,973,433 11/1990 Gilbert et al. .
5,028,211 7/1991 Mordue et al. .
5,078,572 1/1992 Amra et al. .
5,092,821 3/1992 Gilbert et al. .
5,098,134 3/1992 Monckton .
5,131,632 7/1992 Olson .
5,143,357 9/1992 Gilbert et al. .
5,203,681 4/1993 Cooper .
5,209,641 5/1993 Hoglund et al. .
5,286,163 2/1994 Amra et al. .
5,308,045 5/1994 Cooper .
5,310,412 5/1994 Gilbert et al. .
5,318,360 6/1994 Langer et al. ..... 416/231 A
5,330,328 7/1994 Cooper .
5,364,078 11/1994 Pelton .
5,399,074 3/1995 Nose et al. ..... 417/423.12
5,454,423 10/1995 Tsuchida et al. .
5,470,201 11/1995 Gilbert et al. .
5,558,505 9/1996 Mordue et al. .
5,586,863 12/1996 Gilbert et al. .
5,597,289 1/1997 Thut ..... 415/200
5,634,770 6/1997 Gilbert et al. .
5,662,725 9/1997 Cooper .
5,678,807 10/1997 Cooper .
5,685,701 11/1997 Chandler et al. .
5,735,668 4/1998 Klein ..... 415/172.1

ROTOR BEARING SYSTEM FOR MOLTEN METAL PUMPS

FIELD OF THE INVENTION

The present invention relates to a system and device for pumping molten metal and, in particular, a fracture-resistant bearing system for use with a molten-metal pump rotor.

BACKGROUND OF THE INVENTION

A number of submersible pumps used to pump molten metal (referred to herein as molten metal pumps) are known in the art. For example, U.S. Pat. No. 2,948,524 to Sweeney et al., U.S. Pat. No. 4,169,584 to Mangalick, U.S. Pat. No. 5,203,681 to Cooper, and pending U.S. patent app. Ser. No. 80/439,739 to Cooper, the disclosures of which are incorporated herein by reference, all disclose molten metal pumps. The term submersible means that when the pump is in use, its base is submerged in a bath of molten metal.

In the field of working with molten metals such as aluminum, three basic different types of pumps are utilized, circulation pumps, transfer pumps and gas-release pumps. Circulation pumps are used to circulate the molten metal within a bath, thereby equalizing the temperature of the molten metal and creating a uniformly consistent alloy. Most often, as is known by those skilled in the art, circulation pumps are used in conjunction with a reverbatory furnace having an external well. The well is usually an extension of the charging well where scrap metal is charged (i.e., added).

Transfer pumps are generally used to transfer molten metal from the external well of the furnace to a different location such as a ladle or another furnace.

Gas-release pumps, such as gas-injection pumps, circulate the molten metal while adding a gas into the flow of molten metal in order to "demag" or "degas" the molten metal. In the purification of molten metals, particularly aluminum, it is frequently desired to remove dissolved gases such as hydrogen, or dissolved metals, such as magnesium. As is known by those skilled in the art, the removing of dissolved gas is known as "degassing" while the removal of magnesium is known as "demagging."

All molten-metal pumps include a pump base that comprises a housing, also called a casing, a pump chamber, which is an open area formed within the housing, and a discharge, which is a channel or conduit communicating with the chamber and leading from the chamber to an outlet formed in the exterior of the casing. A rotor, also called an impeller, is mounted in the pump chamber and connected to a drive system, which is typically one or more vertical shafts that eventually connect to a motor. As the drive system turns the rotor, the rotor pushes molten metal out of the pump chamber, through the discharge, out of the outlet and into the molten metal bath.

A bearing member is added to the pump casing, which is preferably a ceramic ring attached to the bottom edge of the chamber. The inner perimeter of the ring forms a first bearing surface. A corresponding bearing member, which is a ceramic ring (referred to herein as a rotor ring), is attached to the rotor, and its outer perimeter forms a second bearing surface. The rotor is vertically aligned in the pump chamber so that the second bearing surface of the rotor aligns with the first bearing surface of the pump chamber. When the rotor turns, the first bearing surface keeps the second bearing surface, and hence the rotor, centered.

A problem encountered with this arrangement is that the ceramic ring attached to the rotor is fragile and often breaks.

It breaks during operation of the pump because of impact against the bearing surface or because pieces of solid material, such as brick or dross present within the aluminum bath, become wedged between the bearing surface and the second bearing surface. The ceramic ring attached to the rotor also breaks during start up because of thermal expansion. In this respect, whenever a rotor including a rotor ring is placed in the pump, the ring is quickly heated from the ambient air temperature within the factory to the temperature of molten aluminum. The ring then expands and can crack. To alleviate cracking due to thermal expansion, the furnace operator may slowly heat the entire furnace to prevent thermal shock to the ring, but this results in downtime and lost production. Finally, the rings are easily damaged during shipping.

SUMMARY OF THE INVENTION

The present invention solves these and other problems by providing a bearing system, which includes a plurality of bearing pins or wedges (collectively referred to herein as bearing pins or pins), that is less prone to fracture than a bearing ring. The geometry of each pin allows for thermal expansion without breaking. Generally, the present invention is a plurality of solid, heat-resistant (preferably refractory material) pins that attached to a molten-metal pump rotor. The perimeter of the rotor containing the pins is called a bearing perimeter. The surfaces of the pins that align with the first bearing surface of the pump casing collectively form a second bearing surface.

The material forming each bearing pin is harder than the material forming the rotor, so as to provide a wear-resistant bearing surface. Preferably, a system according to the invention will include a rotor having a plurality of bearing pins equally radially spaced about the rotor. In use, the rotor is mounted within the pump chamber of a molten metal pump so that the bearing pins form a second bearing surface that aligns with the first bearing surface provided in the pump casing.

In another aspect of the invention, a first bearing surface consists of a plug of heat resistent material formed in the base of the molten metal pump chamber and the second bearing surface is formed by a surface of a bore or recess formed in the bottom of the rotor. When the rotor is placed in the pump chamber it is seated on the plug, which is received in the bore or recess in the rotor base. This configuration not only centers the rotor, it vertically aligns the rotor in the pump chamber as well. Furthermore, this arrangement can be reversed, with a plug extending from the bottom of the rotor and forming a second bearing surface, a recess or bore is then formed in the base of the pump chamber. The plug is received in the recess and a surface of the recess forms the first bearing surface.

Also disclosed is a rotor especially designed to receive the bearing pins and a molten metal pump including a rotor with bearing pins.

It is therefore an object of the invention to reduce the breakage of bearing members used in molten metal pumps during operation of the pump.

It is another object of the present invention to reduce the breakage of bearing members during the start up of a molten metal pump.

It is another object of the present invention to reduce the breakage of bearing members used in molten metal pumps during shipping.

DETAILED DESCRIPTION OF A PREFERRED EMBODIMENT

In the present invention, the materials forming all bearing components are preferably structural refractory material, which preferably has high abrasion resistance, and high resistance to disintegration by either corrosive or erosive attack from the molten metal. The material should have capacity to remain relatively stable and to not introduce contaminants into the molten metal. Structural carbonaceous refractory materials, such as carbon of a dense or structural type, including graphite, graphitized carbon, clay-bonded graphite, carbon-bonded graphite, silicon carbide, or the like have all been found to be highly resistant to attack by molten aluminum. Such materials may be coated or uncoated and glazed or unglazed. Pump parts composed of suitable materials may be made by mixing ground graphite or silicon carbide with a fine clay binder, forming the part and baking. The parts may be subjected to simple machining operations for the silicon carbide or "hard" ceramics or complex machining operations for graphite or "soft" ceramics. Alternatively, some parts such as the support posts can be made from a metal having a suitable coating of refractory material. These materials and the method(s) of producing components using these materials are known to those skilled in the art.

Figure 1:
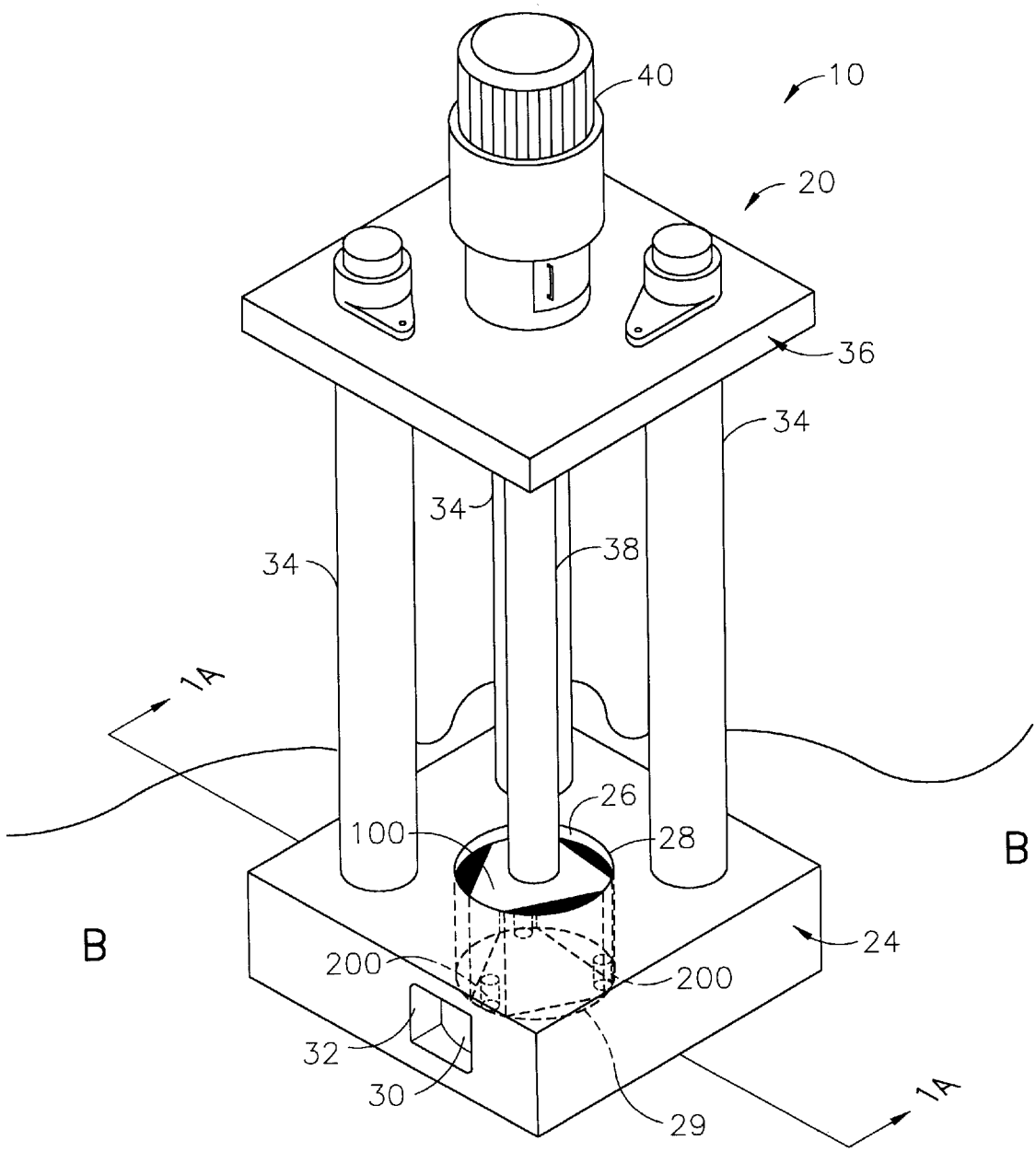
FIG. 1 is a perspective view of a pump for pumping molten metal, which includes a rotor and bearing pins in accordance with the invention.

Referring now to the drawings where the purpose is to illustrate and describe a preferred embodiment of the invention, and not to limit same, FIG. 1 shows a system 10 in accordance with the present invention. System 10 includes a pump 20 having a rotor 100, which includes a plurality of bearing pins 200.

Pump 20 is specifically designed for operation in a molten metal furnace or in any environment in which molten metal is to be pumped or otherwise conveyed. Pump 20 can be any structure or device for pumping or otherwise conveying molten metal. A preferred pump 20 is disclosed in U.S. Pat. No. 5,203,681 to Cooper entitled "Submersible Molten Metal Pump," the disclosure of which is incorporated herein by reference. Basically, the preferred embodiment of pump 20, which is best seen in FIG. 1, has a pump base, or casing, 24 submersible in a molten metal bath B. Pump base 24 includes a generally nonvolute pump chamber 26 (although a volute, or any shape chamber, could be used) having top inlet 28, bottom inlet 29, tangential discharge 30 (although another type of discharge, such as a radial discharge may be used), and outlet 32. A plurality of support posts 34 connects base 24 to a superstructure 36 of pump 20 thus supporting superstructure 36. A rotor drive shaft 38 is connected at one end to rotor 100 and at the other end to a coupling (not shown). Pump 20 is usually positioned in a pump well, which is part of the open well of a reverbatory furnace.

A rotor, also called an impeller, 100 is contained within pump chamber 26. Rotor 100 is preferably imperforate, triangular, and includes a circular base 104 (as shown in FIG. 2) although any type or shape of rotor or impeller may be used to practice the invention.

Figure 1A:
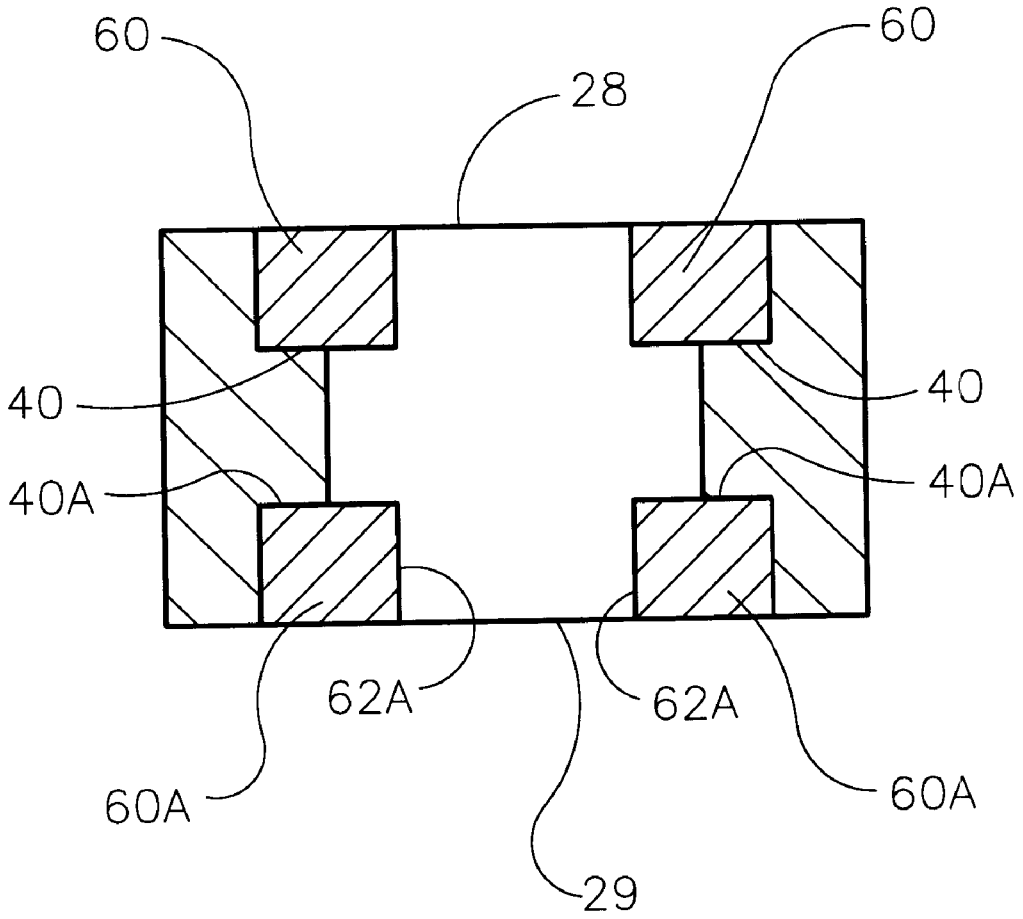
FIG. 1A is a cross-sectional view taken along line 1A—1A of FIG. 1 with the rotor removed.

Preferably, the two inlet openings, top inlet 28 and bottom inlet 29, are provided with one of the two preferably being blocked, and most preferably bottom inlet 29 being blocked, by rotor base 104. As shown in FIG. 1A, pump base 24 can have a stepped surface 40 defined at the periphery of chamber 26 at inlet 28 and a stepped surface 40A defined at the periphery inlet 29, although one stepped surface would suffice. Stepped surface 40 preferably receives a bearing ring member 60 and stepped surface 40A preferably received a bearing ring member 60A. Each bearing member 60, 60A is preferably a ring of silicon carbide. Its outer diameter varies with the size of the pump, as will be understood by those skilled in the art. Bearing member 60 has a preferred thickness of 1". Preferably, bearing ring member 60, is provided at inlet 28 and bearing ring member 60A is provided at inlet 29, respectively, of casing 24. Alternatively, bearing ring members 60, 60A need not be used; all that is necessary for the invention to function is the provision of a first bearing surface to guide rotor 100. In the preferred embodiment, bottom bearing ring member 60A includes an inner perimeter, or first bearing surface, 62A, that aligns with a second bearing surface and guides rotor 100 as described herein.

Figure 2:
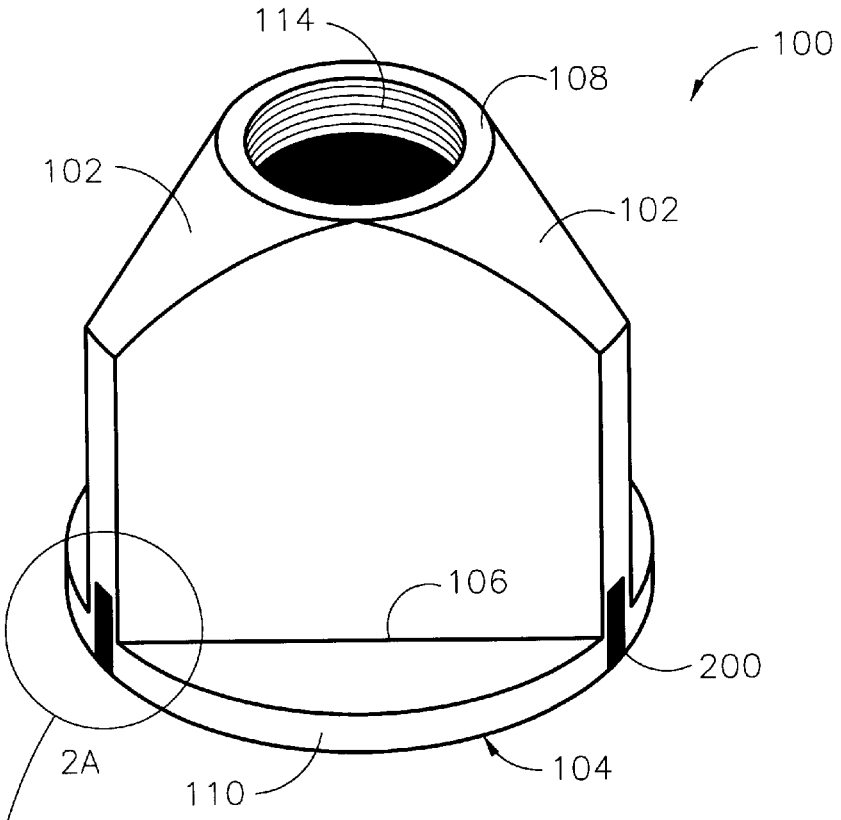
FIG. 2 is a front perspective view of a rotor including bearing pins according to the invention.

The preferred rotor 100, shown in FIG. 2, is imperforate, polygonal, mountable in chamber 26 and sized to fit through both inlet openings 28 and 29. Rotor 100 is preferably triangular (or trilobal), having three vanes 102. Rotor 100 also has a connecting portion 114 to connect to rotor drive shaft 36. A base, also called a flow-blocking and bearing plate, 104 is mounted on either the bottom 106 or top 108 of rotor 100. Bearing pins 200 are attached to base 104 of rotor 100 along outer perimeter 110. Base 104 is sized to rotatably fit and be guided by the appropriate one of bearing ring members 60 or 60A mounted in casing 24. In the embodiment shown, base 104 has an outer perimeter 110.

Figure 3:
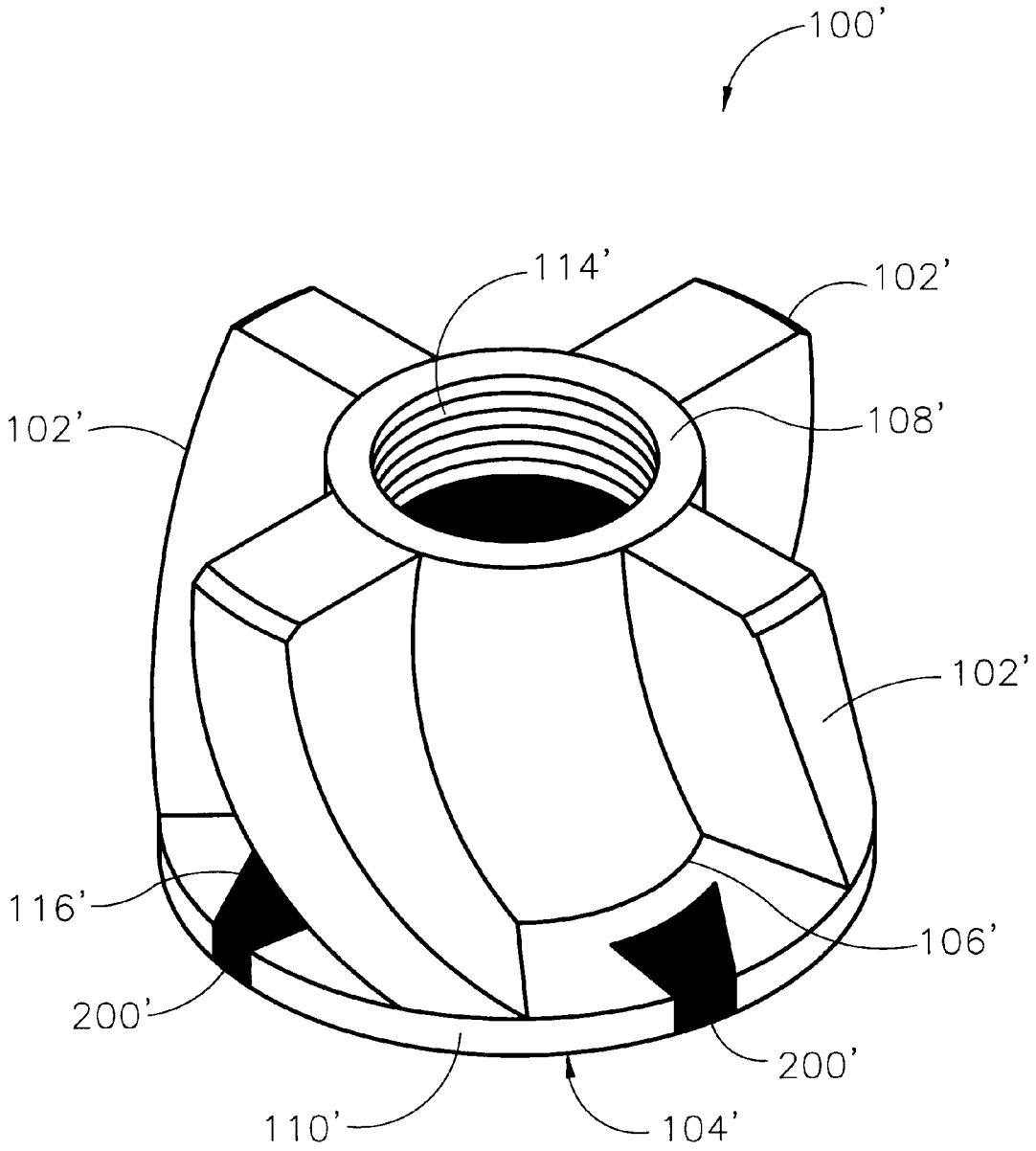
FIG. 3 is a perspective view of an alternate rotor including alternate bearing pins according to the invention.
Figure 5:
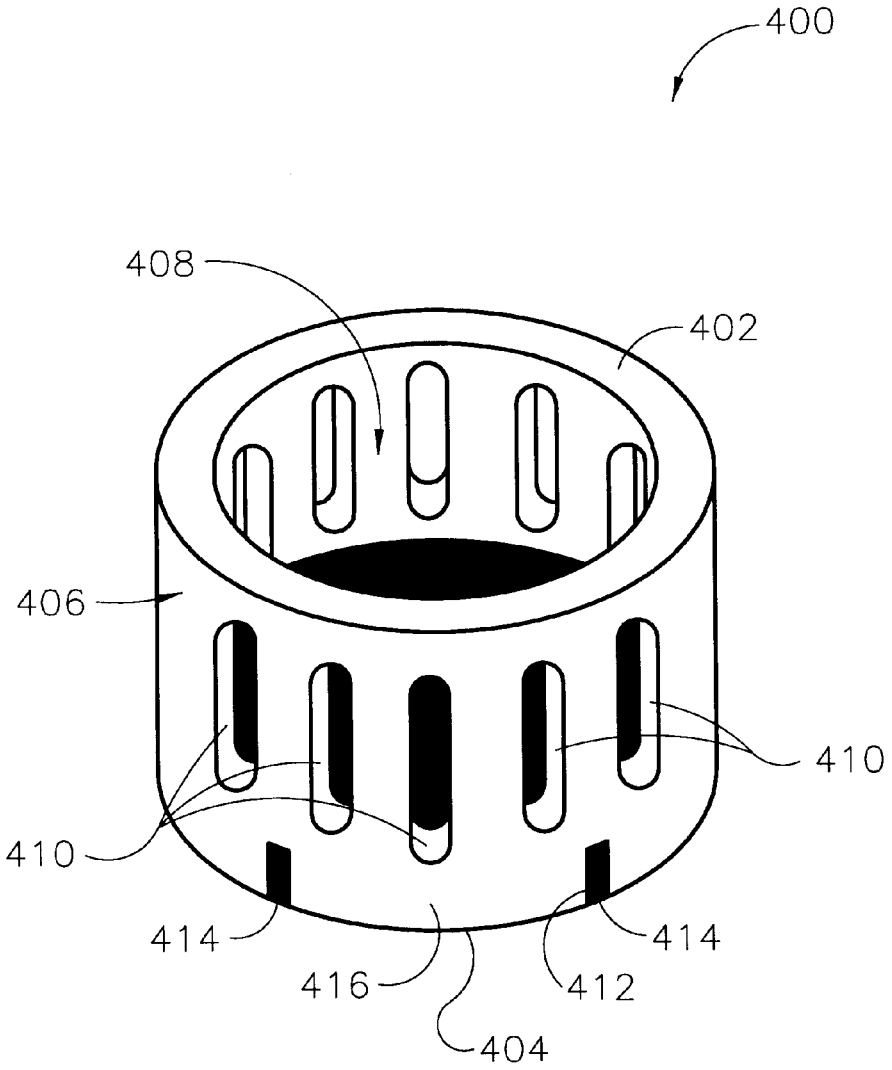
FIG. 5 is a perspective view of a bird-cage rotor including bearing pins according to the invention.
Figure 6:
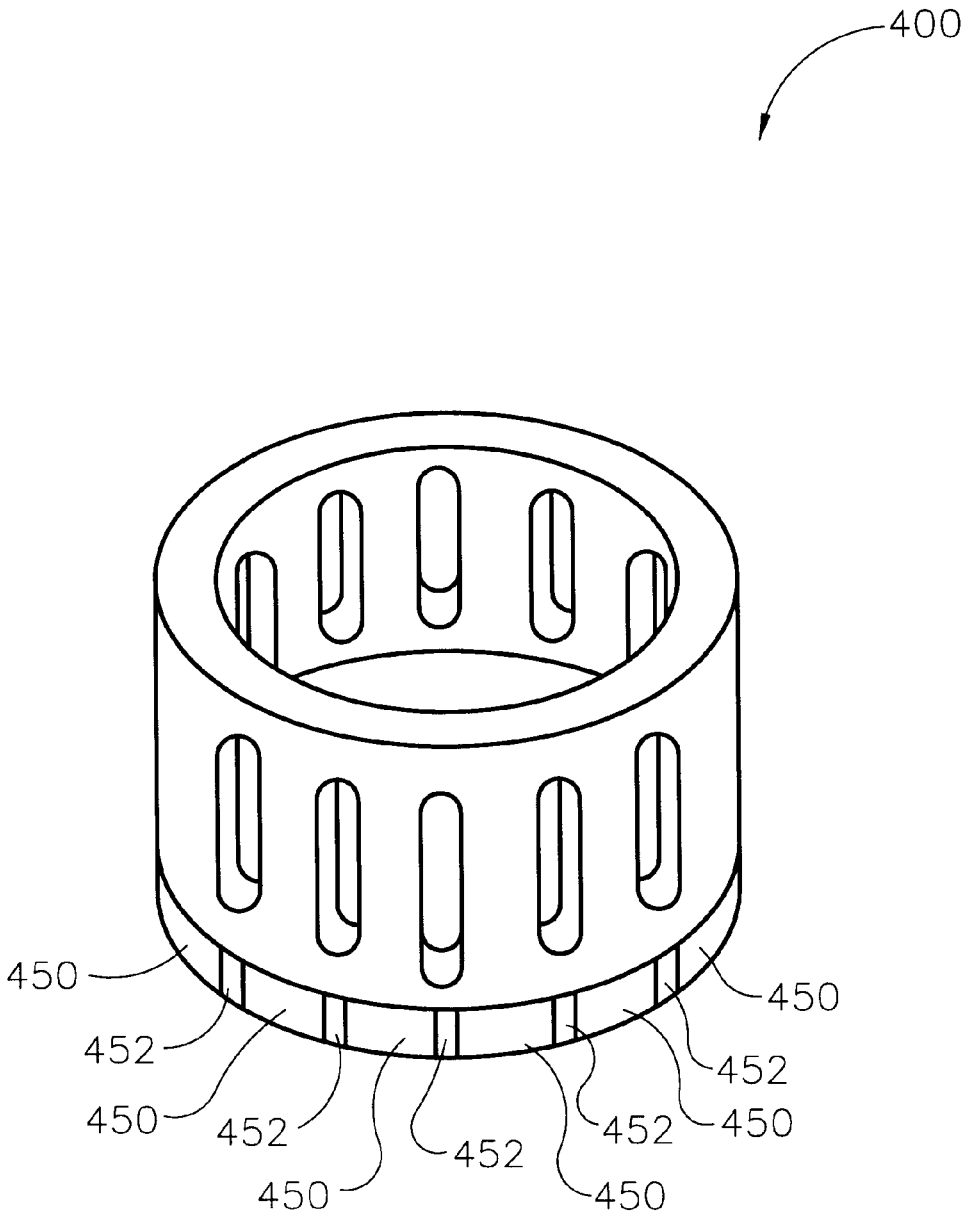
FIG. 6 is a perspective view of a rotor including a split-ring embodiment of the invention.
Figure 7:
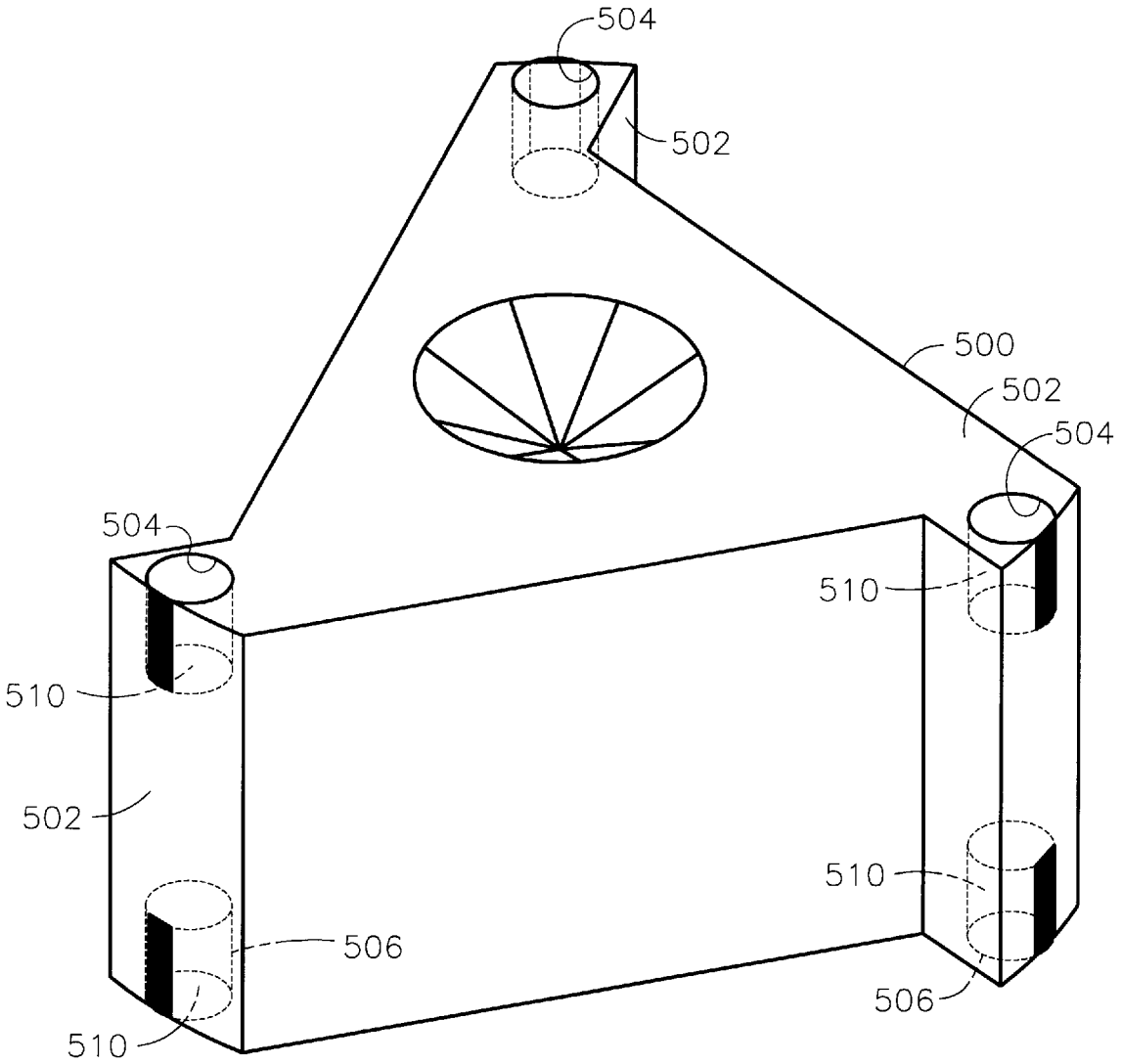
FIG. 7 is a perspective view of a dual-flow rotor in accordance with the invention.

The rotor used in the present invention can be of any configuration, such as a vaned impeller or a bladed impeller (as generally shown in FIGS. 3 and 7), or a bird-cage impeller (as generally shown in FIGS. 5 and 6), these terms being known to those skilled in the art, and the rotor may or may not include a base. As used herein, the term "section" refers to bearing pins, wedges or arcuate sections, such as the ones described herein. The scope of the invention encompasses any rotor used in a molten metal pump whereby a plurality of bearing sections are mounted in or on the rotor to create a second bearing surface that aligns with a first bearing surface to guide the rotor during operation.

The bearing sections are positioned along a bearing perimeter of the rotor. As used herein, the term bearing perimeter refers to any perimeter or portion of a rotor that aligns with the first bearing surface of the pump base 24. The bearing perimeter may be formed on the rotor base, or on the rotor vanes, and it may or may not constitute the rotor's greatest width. The outer surfaces of the bearing pins collectively form a second bearing surface that aligns with the first bearing surface in order to guide the rotor. The second bearing surface, therefore, is discontinuous and comprised of a plurality of spaced-apart sections.

When rotor 100 is assembled into chamber 26 of base 24, there is preferably a gap of 0.030"–0.125" and most preferably 0.040"–0.060" between the first bearing surface 62, of ring 60A and the second bearing surface, which is formed by the collective outer surfaces of sections 200.

Figure 2A:
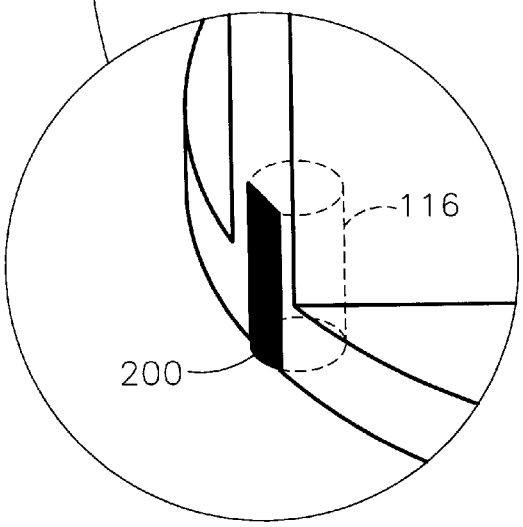
FIG. 2A is an enlarged view of area 2A in FIG. 2 showing in phantom a bearing pin according to the invention.
Figure 2B:
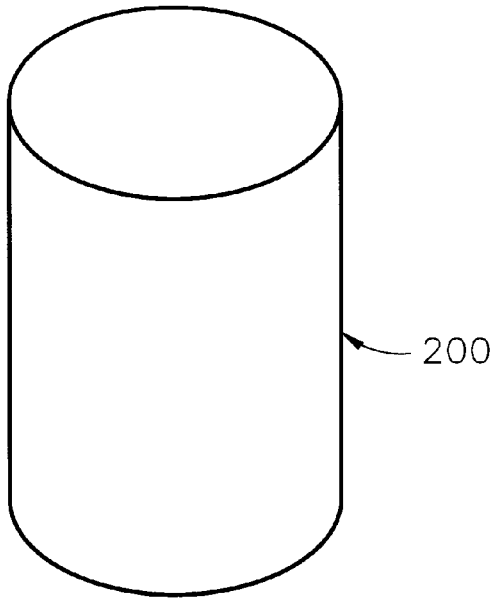
FIG. 2B is a perspective view of the bearing pin shown in FIG. 2.

In the preferred embodiment, pin 200, best seen in FIGS. 2A and 2B, is a solid refractory member having a hardness H greater than the hardness of the material comprising rotor 100. As rotor 100 is preferably comprised of solid graphite, each pin 200 is preferably harder than graphite and is most preferably comprised of silicon carbide. Pin 200 is preferably solid and can be of any shape; it need only be designed so that its configuration and dimensions are such that it is not prone to breaking during shipping or usage. In the embodiment shown in FIGS. 2–2B, pin 200 is preferably a 1⅛" diameter cylinder having a length L substantially equal to the thickness of rotor base 104, although a pin having a diameter of ¼" or greater would suffice and the length L could be less than or greater than the thickness of the rotor base, although it is preferred that L be at least ½", and it is most preferred that L be ¾" or greater. As shown in FIG. 2A, preferably over 50% of the mass of each pin 200 is embedded in rotor 100.

Each pin 200 is preferably attached to rotor 100 within a recess 116 formed to receive pin 200. The recess aligns the outer surface of each pin 200 so that it is preferably substantially flush with the outer surface 110 of base 104, although pin 200 can extend beyond base 104. Depending upon the configuration of pin 200, the design of pump chamber 26 and rotor 100, and the method of attachment of pin 200 to rotor 100, pins 200 can extend outward from rotor 100 by practically any distance.

As used herein, the term substantially flush refers to a configuration in which the outer surface of pin 200 is flush with, or up to 0.040" inside of, the outer surface 110 of rotor 100. Alternatively, pins 200 may extend beyond outer surface 110 of rotor 100 by 0.001 to 0.009 inches or more. Recess 116 also helps to contain pin 200, reducing thermal expansion, thereby helping to reduce thermal fracture. When inserted into recess 116, pin 200 is preferably cemented in place. When a plurality of pins are mounted in a rotor, such as pins 200 in rotor 100 as shown in FIG. 2, their outer surfaces collectively form a second bearing surface which is aligned with the first bearing surface of the pump housing 24.

Figure 3A:
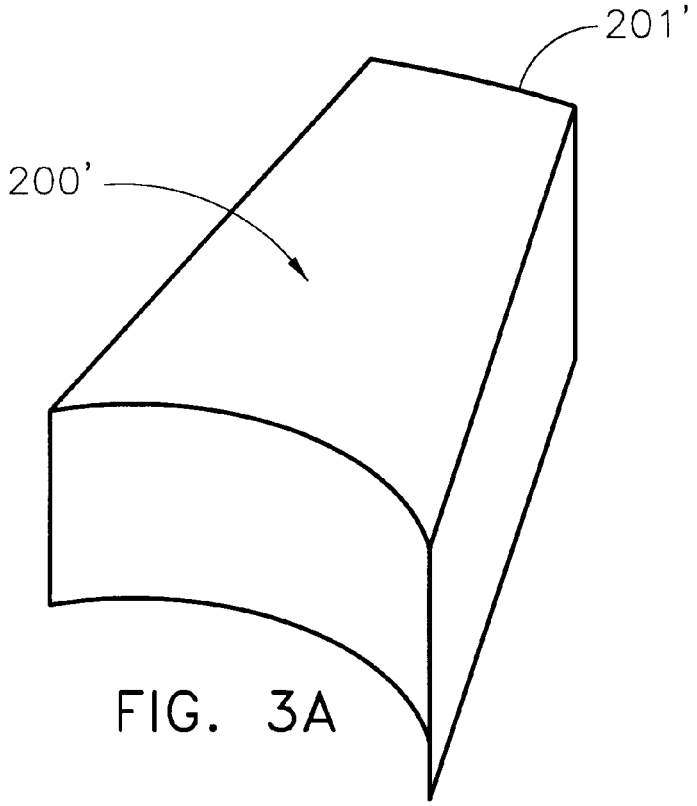
FIG. 3A is a perspective view of the bearing pin shown in FIG. 3.
Figure 3B:
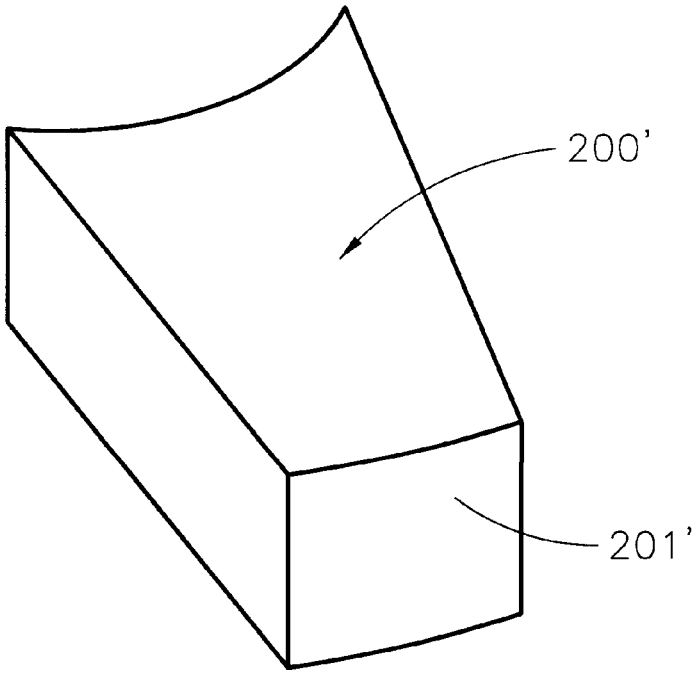
FIG. 3B is side perspective view of the bearing pin shown in FIG. 3.

An alternate embodiment shown in FIGS. 3–3B shows a quadralobal impeller 100 with base 104' having an outer perimeter 110', and pins 200', shown in FIGS. 3A–3B, as being wedge-shaped refractory members formed within recesses 116'. The collective outer surfaces 201' of pins 200' (best seen in FIGS. 3A and 3B) form the second bearing surface.

Figure 2C:
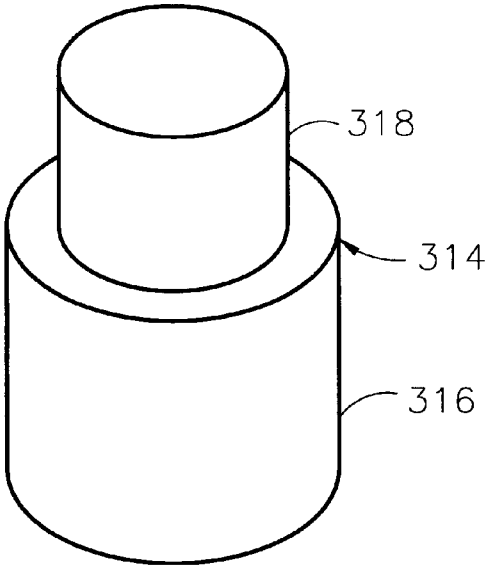
FIG. 2C is a perspective view of an alternative bearing pin profile.
Figure 4:
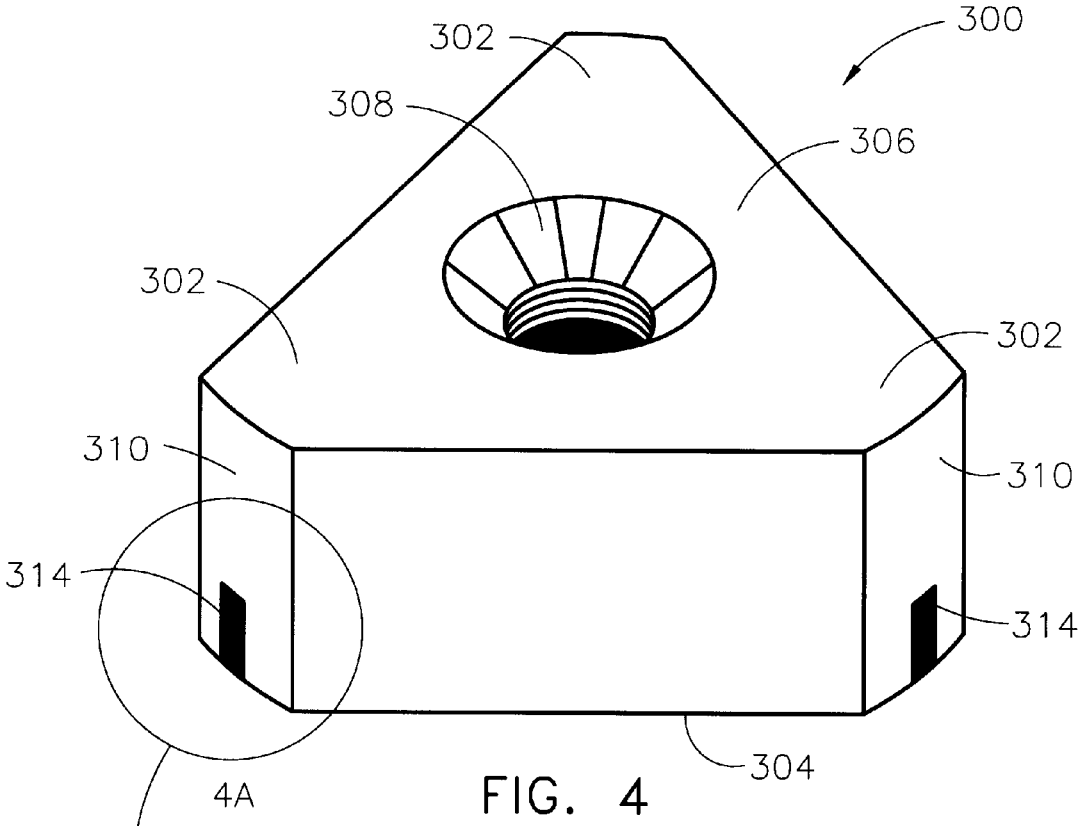
FIG. 4 is a perspective view of an alternate rotor including alternate bearing pins according to the invention.
Figure 4A:
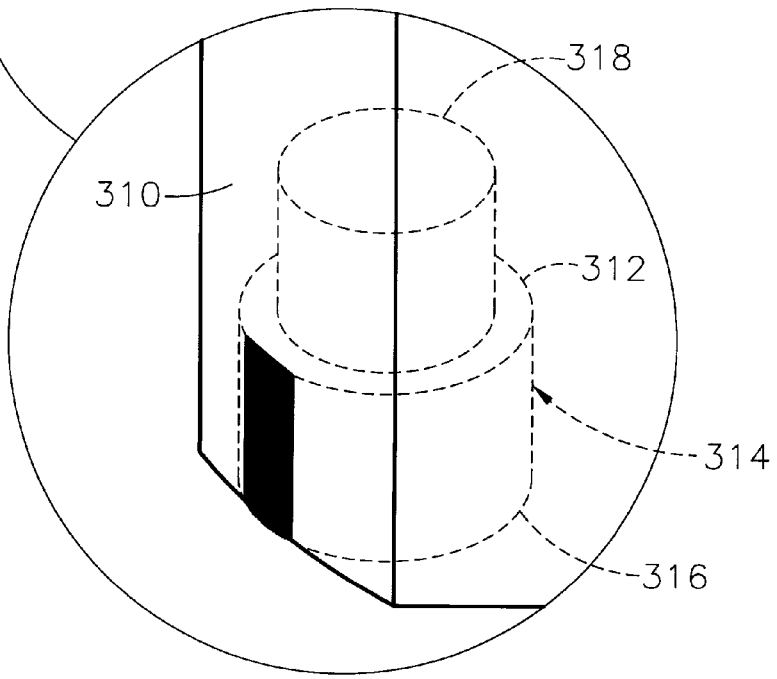
FIG. 4A is an enlarged view of area 4A in FIG. 4 showing in phantom the alternate bearing pins of FIG. 4.

Another embodiment of the invention is shown in FIGS. 4 and 4A, which shows a triangular (or trilobal) rotor 300, that does not include a base. Rotor 300 has three vanes 302, a bottom 304, a top 306, and a connective portion 308. Each vane 302 has an outer tip 310 having a recess 312 formed therein. A bearing pin 314, best shown in FIGS. 2C and 4A, is attached to each vane 302, one being inserted in each recess 312. Each pin 314 is solid and stepped, being formed as two coaxial cylinders 316, 318, with cylinder 316 preferably having a diameter of 1½" and cylinder 318 preferably having a diameter of 1⅛".

A second bearing surface is formed by the collective outer surfaces of pins 314, which is aligned with a first bearing surface. Preferably, pins 314 are substantially flush with or extend slightly outward from the respective outer surfaces of tips 310 of vanes 302.

FIG. 5 shows a bird-cage rotor 400, which is normally used with a casing having a volute pump chamber (not shown), which is known by those skilled in the art. Rotor 400 has a top 402, a bottom 404 and an annular side wall 406 defining a cavity 408. Openings 410 are formed in sidewall 406. Recesses 412 are formed about the lower perimeter of wall 406, and recesses 412 receive and retain bearing pins 414. Each pin 414 is preferably cylindrical, having the same dimensions as previously-described pins 200. The collective outer surfaces of pins 414 form a second bearing surface, which is aligned to mate with a first bearing surface (not shown). Preferably, pins 414 are substantially flush with, or extend slightly outward from, annular wall 406.

Another alternate embodiment is shown in FIG. 6 wherein bird-cage rotor 400 includes split-ring members 450. Each member 450 may be a wedge-like member, such as is shown in FIGS. 3A and 3B. Alternatively, as shown in FIG. 6, members 450 may be curved sections, wherein the outer surface of each member 450 forms an arc of a circle having a diameter substantially equal to the outer diameter of impeller 400. A gap 452 separates each individual bearing component 450.

Another alternative of the present invention is shown in FIG. 7. There is shown a dual flow impeller 500 having three vanes 502. Each vane 502 has a recess 504, on its upper end, and a recess 506, on its lower end. Each recess 504 and 506 receive a cylindrical pin 510 which is similar to pins 200, preciously described. The exterior surfaces of pins 500 form an upper second bearing surface and a lower second bearing surface.

Figure 8:
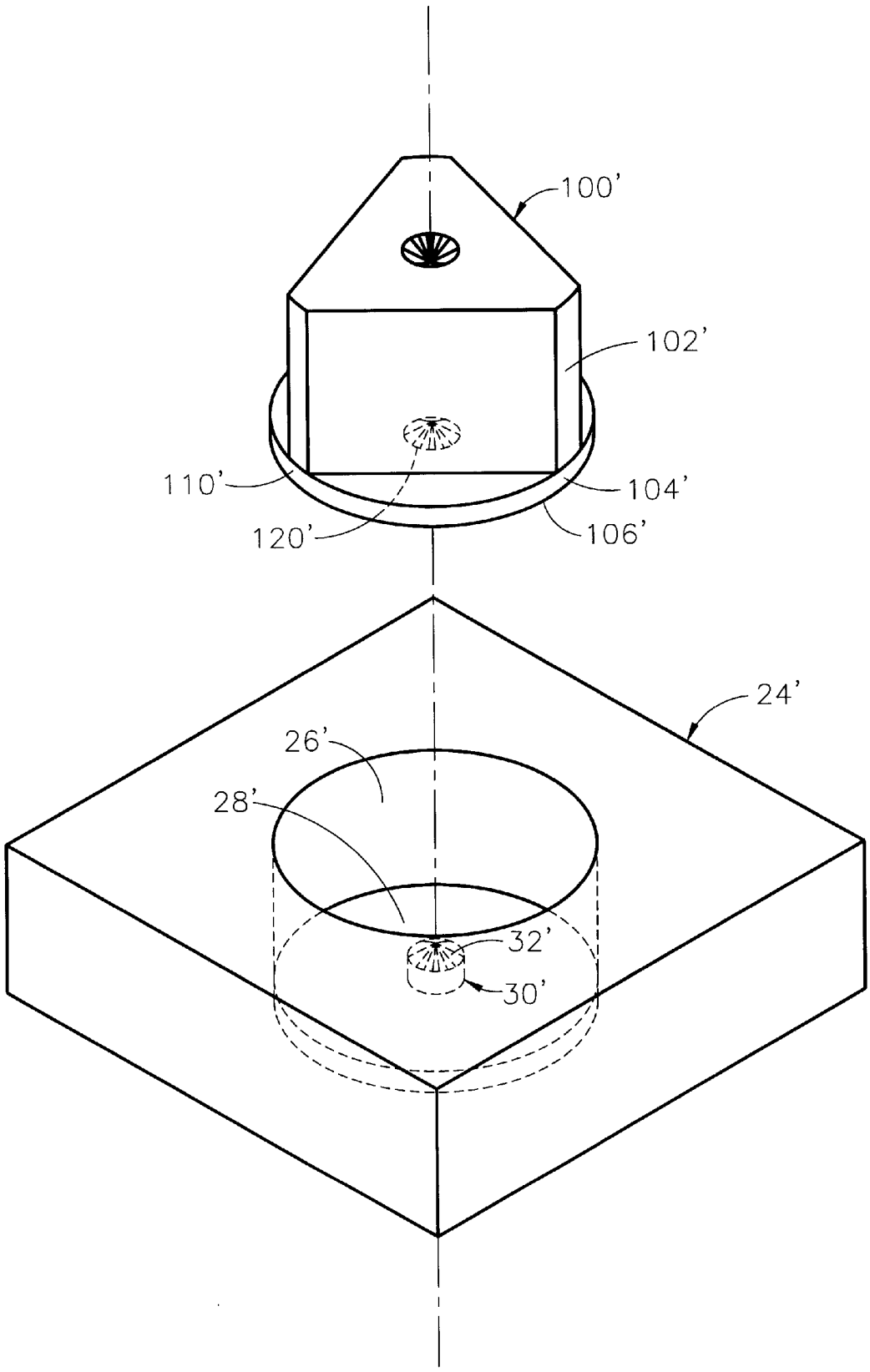
FIG. 8 is a perspective view of an alternate pump housing and rotor in accordance with the invention, which includes a plug in the pump chamber base.
Figure 9:
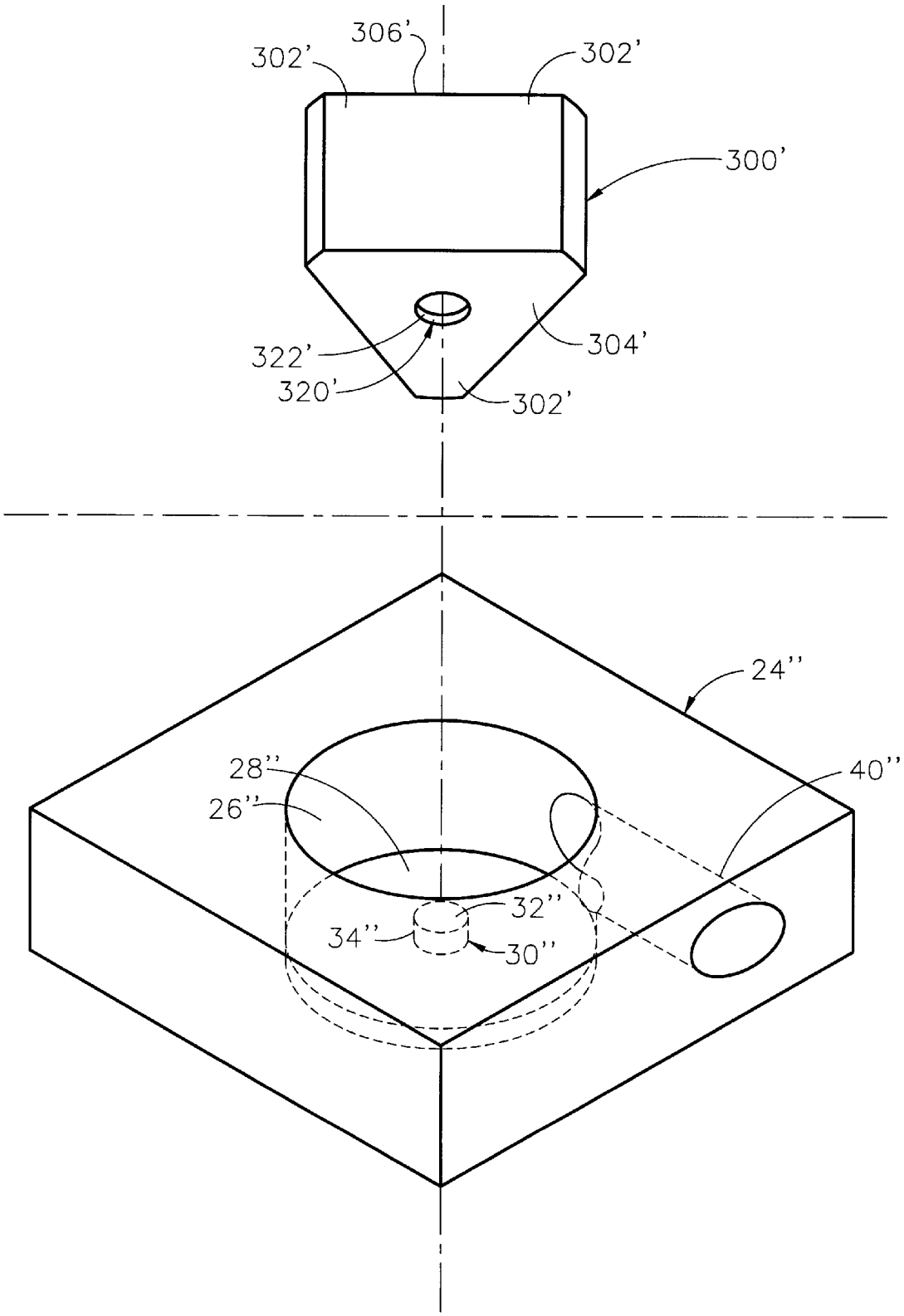
FIG. 9 is a perspective view of an alternate embodiment of the present invention, which includes a bearing plug in the pump chamber base and a bore in the rotor bottom.
Figure 10:
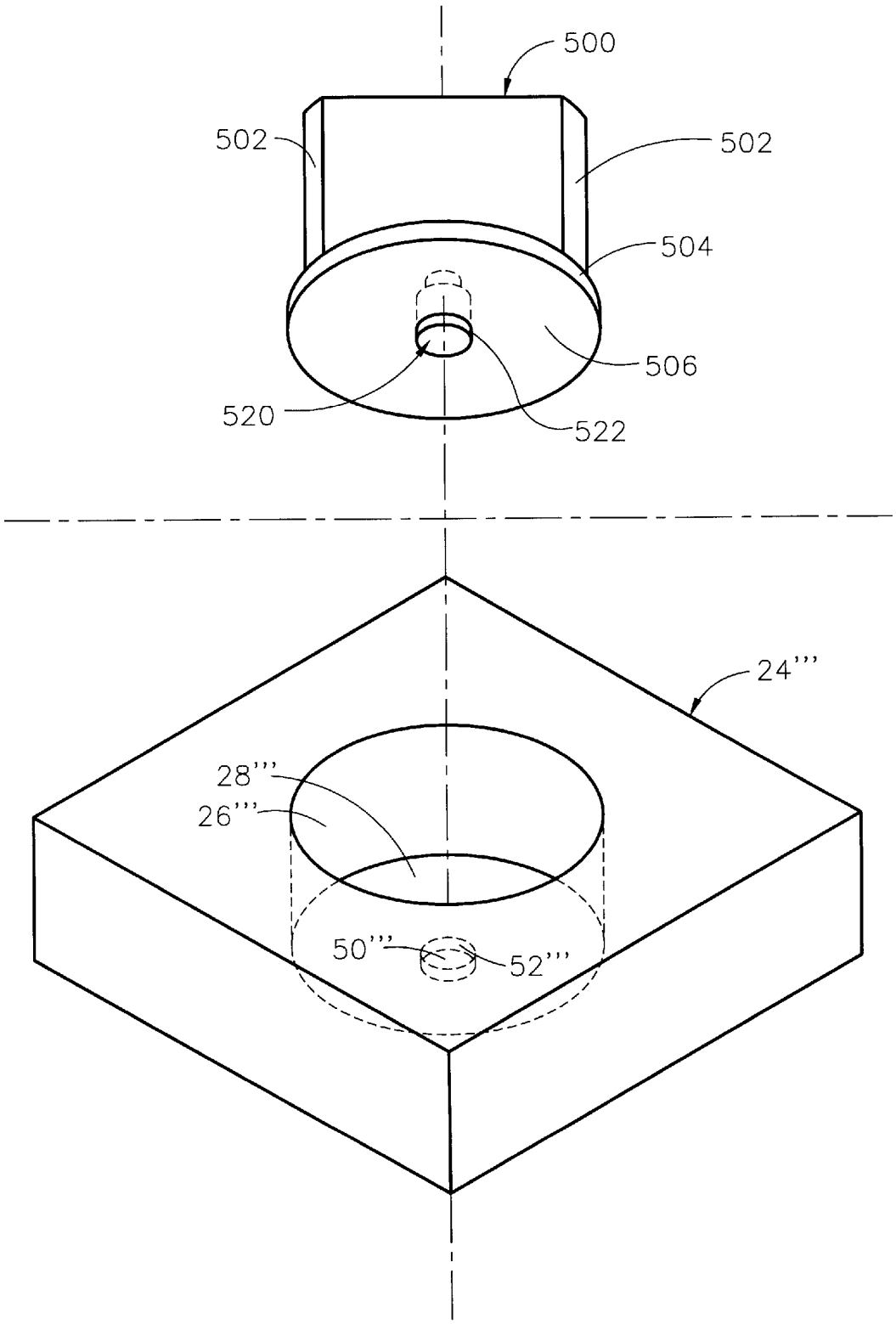
FIG. 10 is a perspective view of an alternate embodiment of the invention including a bearing plug extending from the rotor bottom.

FIGS. 8–10 show configurations in which a bearing plug and corresponding recess, rather than a plurality of bearing pins, are used to guide the rotor and vertically align the rotor in the pump chamber.

FIG. 8 shows an alternate pump housing 24' and rotor 100' in accordance with the invention. Pump housing 24' has a pump chamber 26' having a base 28'. A bearing plug 30' extends from base 28' and preferably has a generally conical top surface 32'. Rotor 100' includes vanes 102', base 104' housing and bottom 106'. A recess, or bore, 120' is formed in the bottom 106' and is dimensioned to received end 32' of plug 30'. End 32' therefore, is the first bearing surface and the surface of recess 120' that aligns with end 32' is the second bearing surface.

FIG. 9 shows a pump base 24" including a pump casing 26" having a base 28". A bearing plug 30" extends from base 28" and preferably has a generally flat top surface 32" and a cylindrical outer surface 34". Rotor 300' has three vanes 302', a bottom 304' and a top 306'. A cylindrical bore, or recess, 320' is formed in bottom 304', and has annular side wall 322'. Bore 320' is dimensioned to receive plug 30". In this embodiment, wall 34" forms the first bearing surface and wall 322' forms the second bearing surface.

FIG. 10 shows a pump base 24'" having a chamber 26'" including a base 2'". A recess, or bore, 50'" is formed in base 28'" and has annular side wall 52'". Rotor 500 has vanes 502, and base 504 having a bottom 506. A bearing plug 520 extends from bottom 506 and has an annular outer surface 522. Plug 520 is dimensioned to be received in recess 50'". In this embodiment, wall 52'" forms the first bearing surface and wall 522 forms the second bearing surface.

Turning again now to FIGS. 1, 1A and 2 to describe the operation of a system according to the invention, motor 40 turns shaft 38 and rotor 100. Rotor 100 is positioned within chamber 26 so that bearing pins 200, which form the second bearing surface, are aligned with bearing surface 62, preferably formed at bottom of chamber 26. Rotor 100 and pins 200 are dimensioned so that a small gap (preferably 0.040"–0.060") exists between bearing surface 62 and the second bearing surface. Motor 40 turns shaft 38 and rotor 100.

Having thus described preferred embodiments of the invention other variations and embodiments that do not depart from the spirit of the invention will become readily apparent to those skilled in the art. The scope of the present invention is thus not limited to any one particular embodiment, but is instead set forth in the appended claims and the legal equivalents thereof.

What is claimed is:

1. A molten metal pump comprising;

a. a superstructure;

b. a pump base formed of refractory material, the base having a pump chamber including a first bearing surface;

c. a support post connecting the restructure to the pump base;

d. a rotor positioned in said pump chamber, said rotor having a top, a bottom and a side and including a plurality of recesses; and e. a bearing section rigidly positioned in at least two of the recesses in said rotor, each of said bearing sections having an outer surface, said collective outer surfaces forming a second bearing surface on the side of the rotor, the second bearing surface being axially aligned with said first bearing surface, wherein the second bearing surface is positioned inside of the first bearing surface to reduce cross-axial movement of the rotor, and wherein the bearing sections do not create a fluid-tight seal with the first bearing surface.

2. The pump of claim 1 wherein the bearing sections are bearing pins.

3. The pump of claim 1 wherein the bearing sections are bearing wedges.

4. The pump of claim 1 wherein the bearing sections are arcuate sections.

5. The pump of claim 1 wherein the first bearing surface is annular and has a diameter and the second bearing surface is formed along an annular bearing perimeter, the annular bearing perimeter having a diameter, the diameter of the perimeter being less than the diameter of the first bearing surface.

6. The pump of claim 1 wherein the rotor has vanes, a recess being formed in at least two of the vanes, a bearing section being rigidly positioned in at least two of the recesses.

7. The pump of claim 1 wherein the rotor further includes a circular base having a side, the recesses being formed in said base and being open to the side.

8. The pump of claim 1 wherein the bearing sections are comprised of silicon carbide.

9. The pump of claim 8 wherein the rotor is comprised of graphite.

10. A rotor formed of refractory material, the rotor for use in a molten metal pump, said pump including a pump base formed of refractory material, the base having a pump chamber therein and a first bearing surface juxtaposed said pump chamber, said rotor comprising:

a. a section for moving molten metal;

b. a section for attachment to a drive shaft;

c. a bottom, a top and a side;

d. a plurality of recesses formed therein; and e. a bearing section rigidly positioned in at least two of said recesses, each of said sections having an outer surface, said outer surface forming a second bearing surface on the side of the rotor.

11. A rotor as defined in claim 2 wherein said rotor has an outer surface next to said recess, and said pins extend beyond said outer surface by at least 0.010".

12. A rotor as defined in claim 2 wherein said rotor has an outer surface next to said recess, and said pins extend outward from said outer surface by a distance of 0.001" to 0.009".

13. A rotor as defined in claim 10 wherein said pins are made of silicon carbide.

14. A rotor as defined in claim 7 wherein said rotor is made of graphite.

15. A rotor as defined in claim 2 wherein said pins are substantially cylindrical and have a diameter of ½"–1½".

16. A rotor as defined in claim 10 wherein said pins have a length of ¾" or greater.

17. A rotor as defined in claim 10 wherein said pins have 50% or more of their mass embedded in said rotor.

18. A rotor as defined in claim 10 which further includes a circular base having a side; said recesses being open to the side.

19. The rotor of claim 10 which includes vanes, a recess being formed in at least two of the vanes, a bearing section being rigidly positioned in at least two of the recesses.

* * * * *